US011199002B2

(12) United States Patent
Bou Harb et al.

(10) Patent No.: US 11,199,002 B2
(45) Date of Patent: Dec. 14, 2021

(54) ACOUSTIC PANEL

(71) Applicant: AXIS LIGHTING INC., Lasalle (CA)

(72) Inventors: Joseph Bou Harb, Riverside, CA (US); Suzanne Massoud, Riverside, CA (US); Howard Yaphe, Lasalle (CA); Andrew Miles, Lasalle (CA); Jean Gagne, Lasalle (CA)

(73) Assignee: Axis Lighting Inc., LaSalle (CA)

( * ) Notice: Subject to any disclaimer, the term of this patent is extended or adjusted under 35 U.S.C. 154(b) by 812 days.

(21) Appl. No.: 16/004,057

(22) Filed: Jun. 8, 2018

(65) Prior Publication Data

US 2019/0017260 A1 Jan. 17, 2019

Related U.S. Application Data

(63) Continuation-in-part of application No. 29/615,179, filed on Aug. 26, 2017, and a continuation-in-part of (Continued)

(51) Int. Cl.

| | |
|---|---|
| ***F21S 8/04*** | (2006.01) |
| ***F21V 33/00*** | (2006.01) |
| ***F21Y 115/10*** | (2016.01) |
| ***F21V 15/01*** | (2006.01) |
| ***E04B 1/86*** | (2006.01) |

(Continued)

(52) U.S. Cl.

CPC ..... *E04B 1/86* (2013.01); *E04B 1/8404* (2013.01); *E04B 1/99* (2013.01); *E04B 9/001* (2013.01); *E04B 9/006* (2013.01); *E04B 9/0407* (2013.01); *E04B 9/18* (2013.01); *E04B 9/225* (2013.01); *E04B 9/366* (2013.01); *F21S 8/04* (2013.01); *F21S 8/061* (2013.01); *F21V 15/01* (2013.01); *F21V 33/006* (2013.01); *F21V 33/0056* (2013.01); *F21Y 2115/10* (2016.08)

(58) Field of Classification Search

CPC . E04B 1/86; E04B 1/8404; E04B 1/99; E04B 9/001; E04B 9/006; E04B 9/0407; E04B 9/18; E04B 9/225; E04B 9/366; F21S 8/04; F21S 8/043; F21S 8/06; F21S 8/061; F21S 8/068; F21V 33/0056; F21V 33/006; F21V 15/01

See application file for complete search history.

(56) References Cited

U.S. PATENT DOCUMENTS

| | | | |
|---|---|---|---|
| D97,213 | S | 10/1935 | Stone |
| D150,527 | S | 8/1948 | Wright |

(Continued)

FOREIGN PATENT DOCUMENTS

| | | |
|---|---|---|
| EP | 3128223 | 2/2017 |
| EP | 3543605 | 9/2019 |

OTHER PUBLICATIONS

GE, LED Luminaires, www.gelighting.com/indoorsolutions (Apr. 2015).

(Continued)

*Primary Examiner* — Alan B Cariaso

(74) *Attorney, Agent, or Firm* — Barnes & Thornburg LLP

(57) ABSTRACT

An elongate acoustic panel for installation in an interior space comprising at least one acoustic surface, an edge region adjacent to the at least one acoustic surface, and a distribution of one or more LED's along the edge region.

17 Claims, 15 Drawing Sheets

Related U.S. Application Data application No. 29/610,783, filed on Jul. 14, 2017, now Pat. No. Des. 875,988.

(60) Provisional application No. 62/532,977, filed on Jul. 14, 2017.

(51) Int. Cl.

| | |
|---|---|
| ***E04B 9/00*** | (2006.01) |
| ***E04B 9/18*** | (2006.01) |
| ***E04B 9/22*** | (2006.01) |
| ***E04B 1/99*** | (2006.01) |
| ***E04B 1/84*** | (2006.01) |
| ***F21S 8/06*** | (2006.01) |
| ***E04B 9/04*** | (2006.01) |
| ***E04B 9/36*** | (2006.01) |

(56) References Cited

U.S. PATENT DOCUMENTS

| | | | | |
|---|---|---|---|---|
| 2,555,000 | A | 5/1951 | Carl | |
| 2,700,100 | A | 1/1955 | Wissinger | |
| 2,715,449 | A * | 8/1955 | Smith | F21S 8/06 181/30 |
| 2,759,093 | A * | 8/1956 | Sundberg | F21V 7/0016 362/234 |
| D206,286 | S | 11/1966 | Ostyn | |
| D301,757 | S | 6/1989 | Hanson | |
| D311,967 | S | 11/1990 | Herst | |
| D330,090 | S | 10/1992 | Walter | |
| 5,452,187 | A | 9/1995 | Belfer et al. | |
| D463,061 | S | 9/2002 | Ludwig | |
| 6,454,431 | B1 | 9/2002 | Grossman | |
| D464,457 | S | 10/2002 | Echito | |
| 6,464,179 | B1 | 10/2002 | Bulvan | |
| 6,702,453 | B2 | 3/2004 | Weedon | |
| D493,009 | S | 7/2004 | Ken | |
| D521,676 | S | 5/2006 | Richner | |
| 7,293,895 | B2 | 11/2007 | Grossman et al. | |
| 7,331,687 | B1 | 2/2008 | Noh | |
| D565,786 | S | 4/2008 | Willmarth | |
| D569,027 | S | 5/2008 | Hakamada | |
| D591,444 | S | 4/2009 | Beno | |
| 7,735,794 | B1 | 6/2010 | Gretz | |
| D624,225 | S | 9/2010 | Federico | |
| D624,231 | S | 9/2010 | Karim | |
| D651,336 | S | 12/2011 | Hartman | |
| D662,245 | S | 6/2012 | Steffy | |
| D670,422 | S | 11/2012 | Siekmann | |
| D695,443 | S | 12/2013 | Kaule | |
| D701,343 | S | 3/2014 | Ng | |
| D708,382 | S | 7/2014 | McGowan | |
| D716,485 | S | 10/2014 | McGowan | |
| D731,103 | S | 6/2015 | Wilke | |
| D735,928 | S | 8/2015 | Hawkins | |
| 9,395,052 | B1 | 7/2016 | Shew | |
| D764,095 | S | 8/2016 | Clark | |
| D776,855 | S | 1/2017 | Rashid | |
| D785,851 | S | 5/2017 | Sonneman | |
| 9,677,746 | B2 | 6/2017 | Ramirez | |
| D796,724 | S | 9/2017 | Sonneman | |
| D797,988 | S | 9/2017 | Sonneman | |
| D806,927 | S | 1/2018 | Rashid | |
| D808,059 | S | 1/2018 | Li | |
| D813,432 | S | 3/2018 | Koshiba | |
| D824,075 | S | 7/2018 | Yu | |
| D825,819 | S | 8/2018 | Sonneman | |
| D826,450 | S | 8/2018 | Clark | |
| D826,462 | S | 8/2018 | Sonneman | |
| 10,151,454 | B2 * | 12/2018 | Farrell | F21V 17/105 |
| D845,538 | S | 4/2019 | Vasylyev | |
| 10,309,634 | B2 | 6/2019 | Webb | |
| D865,263 | S | 10/2019 | Amato | |
| 10,443,823 | B2 | 10/2019 | Beland et al. | |
| D895,195 | S | 9/2020 | Bou | |
| 10,788,191 | B1 | 9/2020 | Berry | |
| 10,889,987 | B2 * | 1/2021 | Patterson | F21S 2/005 |
| 10,961,700 | B2 * | 3/2021 | Udagawa | E04B 1/84 |
| D929,018 | S | 8/2021 | Hsu | |
| 2006/0146531 | A1 | 7/2006 | Reo | |
| 2008/0190043 | A1 | 8/2008 | Beckmann | |
| 2008/0266842 | A1 * | 10/2008 | Skidmore | E04B 9/32 362/147 |
| 2009/0296381 | A1 | 12/2009 | Dubord | |
| 2009/0316396 | A1 | 12/2009 | Tsai | |
| 2011/0122603 | A1 | 5/2011 | Shamshoian | |
| 2012/0182755 | A1 | 7/2012 | Wildner | |
| 2013/0050997 | A1 | 2/2013 | Bretschneider | |
| 2013/0235576 | A1 | 9/2013 | McGowan | |
| 2014/0117107 | A1 | 5/2014 | Vogtner | |
| 2014/0226316 | A1 | 8/2014 | Medendorp, Jr. et al. | |
| 2014/0362574 | A1 | 12/2014 | Barrett | |
| 2015/0009664 | A1 | 1/2015 | Liang | |
| 2015/0068135 | A1 * | 3/2015 | Waters | E04B 9/366 52/39 |
| 2015/0070882 | A1 | 3/2015 | Ohno | |
| 2015/0198311 | A1 | 7/2015 | O'Brien | |
| 2015/0300605 | A1 | 10/2015 | Clark | |
| 2015/0338068 | A1 | 11/2015 | Bolscher | |
| 2015/0364853 | A1 | 12/2015 | Thiissen | |
| 2016/0245488 | A1 | 8/2016 | Clark | |
| 2017/0082253 | A1 | 3/2017 | Sorensen | |
| 2018/0231707 | A1 | 8/2018 | De | |
| 2018/0249560 | A1 | 8/2018 | Ando | |
| 2018/0283004 | A1 * | 10/2018 | Gillette | E04B 9/366 |
| 2018/0313503 | A1 | 11/2018 | Sonneman | |
| 2019/0094456 | A1 | 3/2019 | Lee | |
| 2019/0346119 | A1 | 11/2019 | Jam | |
| 2020/0217488 | A1 | 7/2020 | Beland | |

OTHER PUBLICATIONS

GE, Lumination LED Luminaires, Linear Suspended Fixture, www.currentbyge.com (Sep. 22, 2016).

Eaton, Corelite Divide-DWI (Jun. 14, 2017).

Eaton Corporation, Converge LED Architectural Luminaires, Neo-Ray (Jan. 2017).

Eaton, SkyBar High Bay LED Luminaire (Jul. 28, 2015).

Vode Lighting, ZipThree Wall Mount (2017).

Esse-Ci Sri, ISDI_DIAMANTE (To the best of the Applicant's knowledge and understanding, the reference does not have a specific publication date but is believed to have been known by the Applicant on or after Dec. 1, 2017. Applicant believes it may have been available before the priority date of the application because the earliest date relating to this material that could be located online is Apr. 2017).

GES Lighting Track System, GES 1-Circuit Global Track System (To the best of the Applicant's knowledge and understanding, the reference does not have a specific publication date but is believed to have been known by the Applicant on or after Dec. 1, 2017. Applicant believes it may have been available before the priority date of the application because the earliest date relating to this material that could be located online is Jun. 2017).

Lighting Services Inc., Recessed Track Installation (2015).

Lumenalpha™ spot, 209272, lumenpulse Global Tek 100 track system installation instructions (2016).

Lytespan Track lighting 9100 (1999).

Philips, Lytespan, Basic, 1 Circuit Track 6000 (2015).

WAC Lighting, J Series 2 Circuit Track (2012).

* cited by examiner

ACOUSTIC PANEL

CROSS REFERENCE TO RELATED APPLICATIONS

This application claims the benefit of priority under 35 U.S.C. § 119(e) to:

U.S. Provisional application No. 62/532,977, filed Jul. 14, 2017, entitled ACOUSTIC PANEL, and is a Continuation-in-Part of copending U.S. Design Patent application No. 29/610,783, filed Jul. 14, 2017, entitled LUMINAIRE STRUCTURE, and U.S. Design Patent application No. 29/615,179, filed Aug. 26, 2017, entitled LUMINAIRE STRUCTURE.

The disclosures set forth in the referenced applications are incorporated herein by reference in their entireties.

FIELD OF THE DISCLOSURE

The present disclosure relates to acoustic panels.

BACKGROUND

Lighting and acoustics are two principal features in the design of a room space. Typically, however, acoustics and lighting are considered separately, and satisfied by light fixtures and acoustic panels of different configurations of shape, texture, thickness, placement, orientation and the like.

It may thus be desirable to provide novel approaches for lighting and/or acoustics, or at least to provide the public with one or more useful alternatives.

SUMMARY

In an aspect, there is provided an acoustic panel for installation in an interior space comprising a linear distribution of one or more light emitting elements (LEE's) along a path. The linear distribution is between a pair of opposed acoustic panel surfaces configured for absorbing and/or diffusing interior sounds in the interior space.

In another aspect, there is provided an elongate acoustic panel for installation in an interior space comprising at least one acoustic surface. An edge region is adjacent to the at least one acoustic surface. A distribution of one or more light emitting elements (LEE's) is provided along the edge region.

In some exemplary embodiments, the at least one acoustic surface includes a boundary region, the edge region being positioned adjacent the boundary region.

In some exemplary embodiments, the at least one acoustic surface includes a pair of opposed outer acoustic surfaces, with the edge region therebetween.

Some exemplary embodiments further comprise an inner panel portion having a periphery, wherein the edge region is defined on the periphery.

Some exemplary embodiments further comprise a pair of outer acoustic panel portions on opposite sides of the inner panel portion.

In some exemplary embodiments, the boundary region has a periphery which transitions between a first mode in which the boundary region is aligned with the edge region and a second mode in which the periphery extends beyond the edge region.

In some exemplary embodiments, the periphery includes at least one transition between at least one first mode and least one second mode.

In some exemplary embodiments, the at least one acoustic surface may provide an NRC rating ranging from about 0.50 to about 0.99.

In some exemplary embodiments, the at least one acoustic surface may provide an NRC rating ranges from about 0.75 to about 0.95.

In some exemplary embodiments, the opposed surfaces have respective peripheries which transition between the first mode and the second mode.

In some exemplary embodiments, the first mode of one of the peripheries aligns with the second mode of an opposed periphery.

Some exemplary embodiments may comprise an enclosure communication with the edge region to receive the LEE's therein.

In another aspect, there is provided an acoustic panel comprising a pair of outer acoustic panel portions forming one or more boundary regions. A central LED fixture structure is sandwiched therebetween, and is configured to deliver light to the boundary regions, at least in part.

In another aspect, there is provided an acoustic panel comprising a pair of outer acoustic panel portions forming one or more boundary regions, and a light emitting element (LEE) fixture structure therebetween, the LEE fixture structure configured to deliver light to the boundary regions, at least in part.

In some exemplary embodiments, the LEE fixture structure includes an edge region and an array of one or more LEE's distributed therealong.

In some exemplary embodiments, the LEE fixture structure is centrally located in the panel.

In another aspect, there is provided a panel assembly comprising a plurality of panels as defined in any claim, exemplary embodiment or example herein.

In some exemplary embodiments, the plurality of panels may include at least one pair of panels with a joining section therebetween.

In some exemplary embodiments, the joining section may comprise one or more surfaces and/or edge regions which are substantially aligned, oriented, parallel or offset relative to at least one corresponding surface and/or corresponding edge region on one or more neighboring surfaces on one or more of the panels.

In some exemplary embodiments, the joining section may include a distribution of one or more LEE's along the edge region.

BRIEF DESCRIPTION OF THE FIGURES

Several exemplary embodiments of the present disclosure will be provided, by way of examples only, with reference to the appended drawings, wherein.

DETAILED DESCRIPTION

Figure 1:
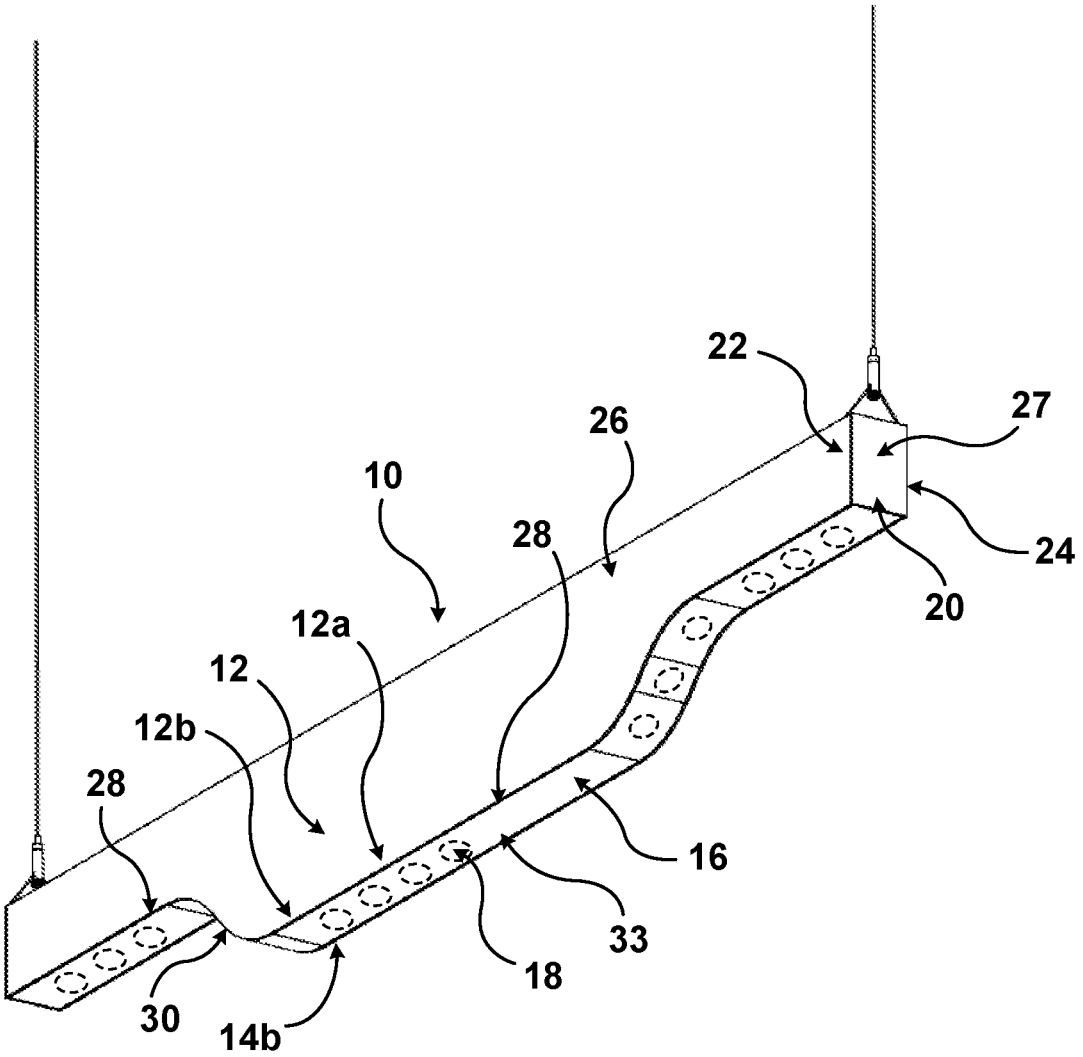
FIGS. 1 to 6 are perspective, side, end, top and bottom views of an exemplary acoustic panel.

It should be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical, mechanical or other connections or couplings. The terms upper, lower, and vertical are intended for operative context only and are not necessarily intended to limit the invention only to those configurations or orientations. Furthermore, and as described in subsequent paragraphs, the specific mechanical and/or other configurations illustrated in the drawings are intended to exemplify embodiments of the invention. However, other alternative mechanical and/or other configurations are possible which are considered to be within the teachings of the instant disclosure.

Figure 2:
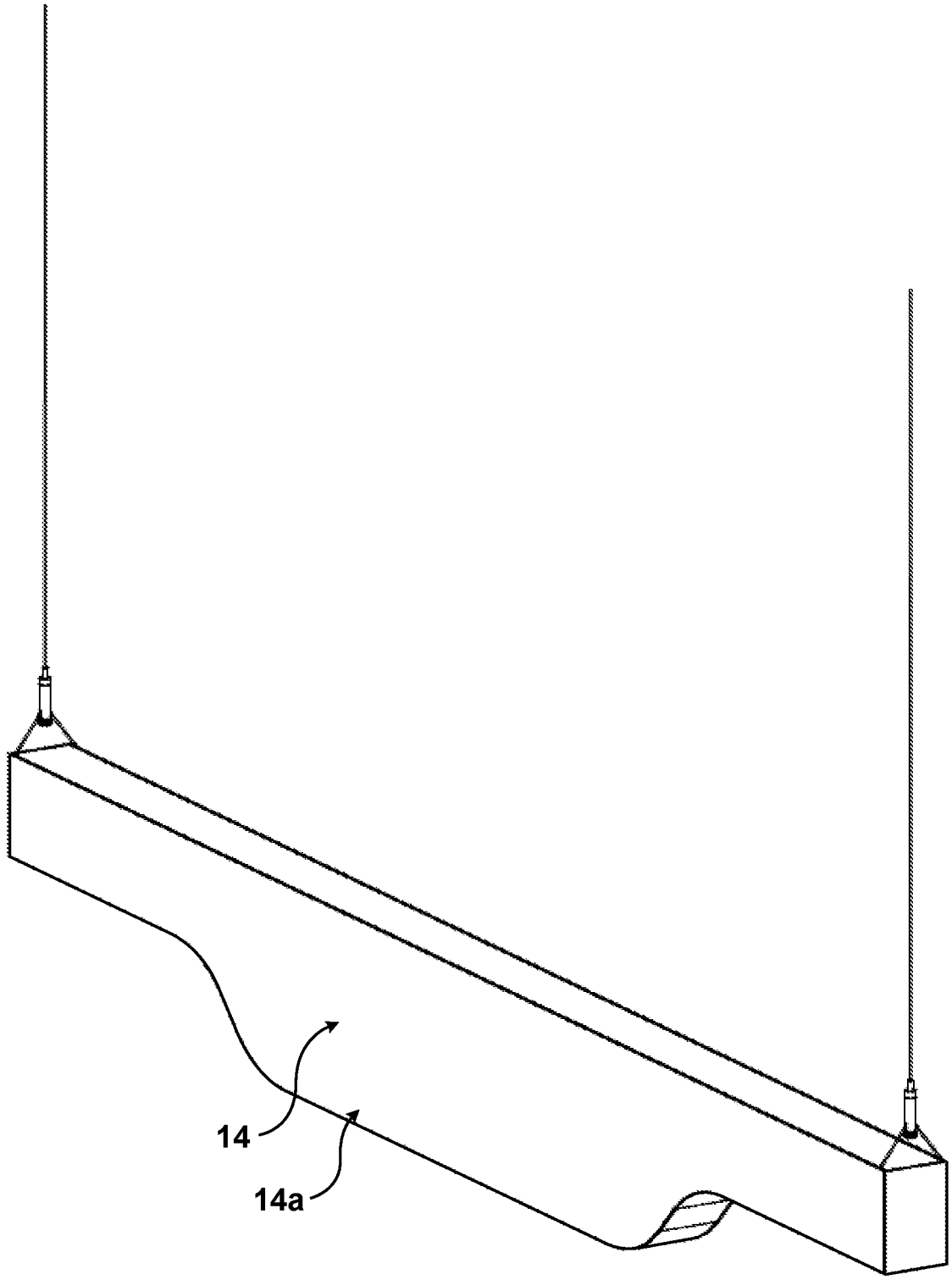

Referring to FIGS. 1 and 2, there is provided an elongate acoustic panel 10 for installation in an interior space. The panel 10 has at least one, in this case a pair of acoustic surfaces 12, 14 and an adjacent elongate edge region 16, along with a distribution of light emitting elements 18, such as, but not limited to, LED's, OLED's and/or other light emitting elements (LEE's) and any devices herein after created and/or devised to provide the same or similar function and/or effect, along the edge region 16. Thus, the LED's described in exemplary embodiments below may be replaced by other LEE's as needs and features may require, or be of improved value in some cases.

The acoustic surfaces 12, 14 include respective boundary regions 12*a*, 14*a*. As can be seen in the exemplary embodiment of FIGS. 1 and 2, the edge region 16 is positioned adjacent the boundary regions 12*a*, 14*a*, thus placing the edge region 16 between them. The acoustic surfaces 12, 14 are provided on respective outer acoustic panel portions 22, 24, which may be part of an extruded structure 26 or the like with an outer layer of acoustic material thereon. End caps 27 may then be provided on each end to close the structure.

Figure 3:
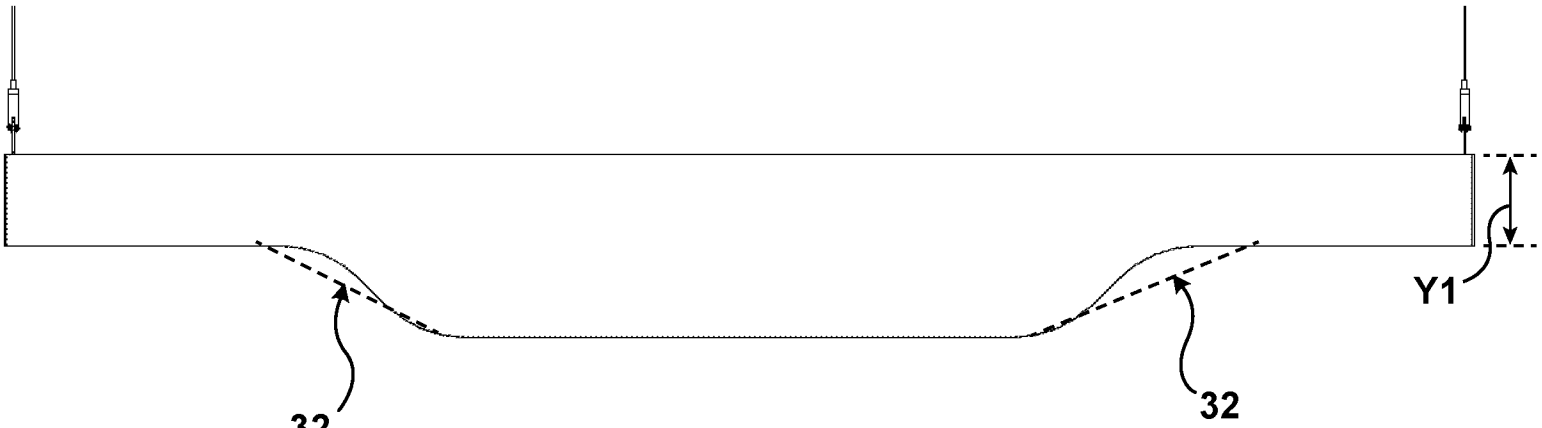
Figure 6:
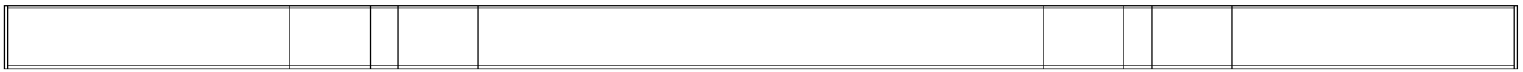
Figure 6A:
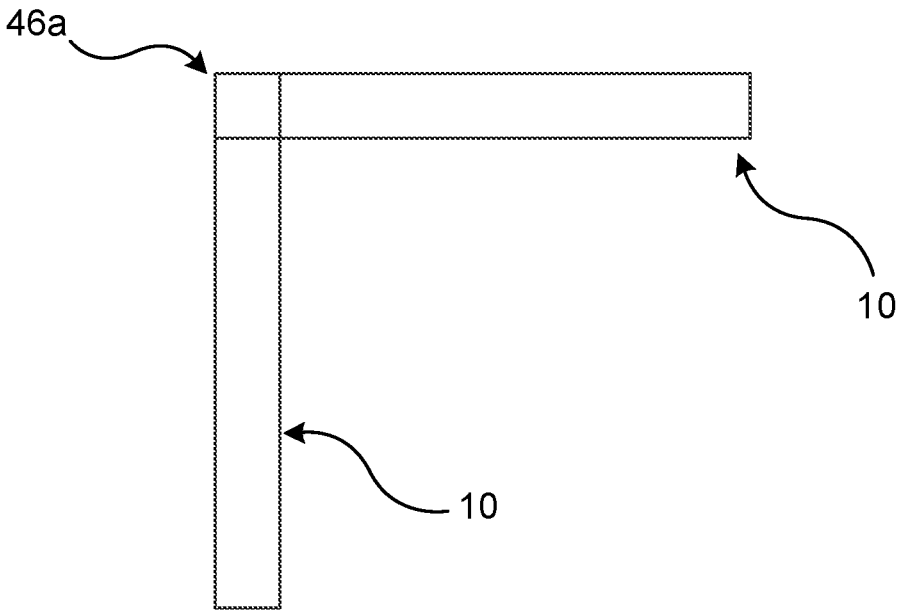
FIGS. 6*a* to 6*c* are schematic plan views of exemplary acoustic panels or portions thereof.
Figure 6B:
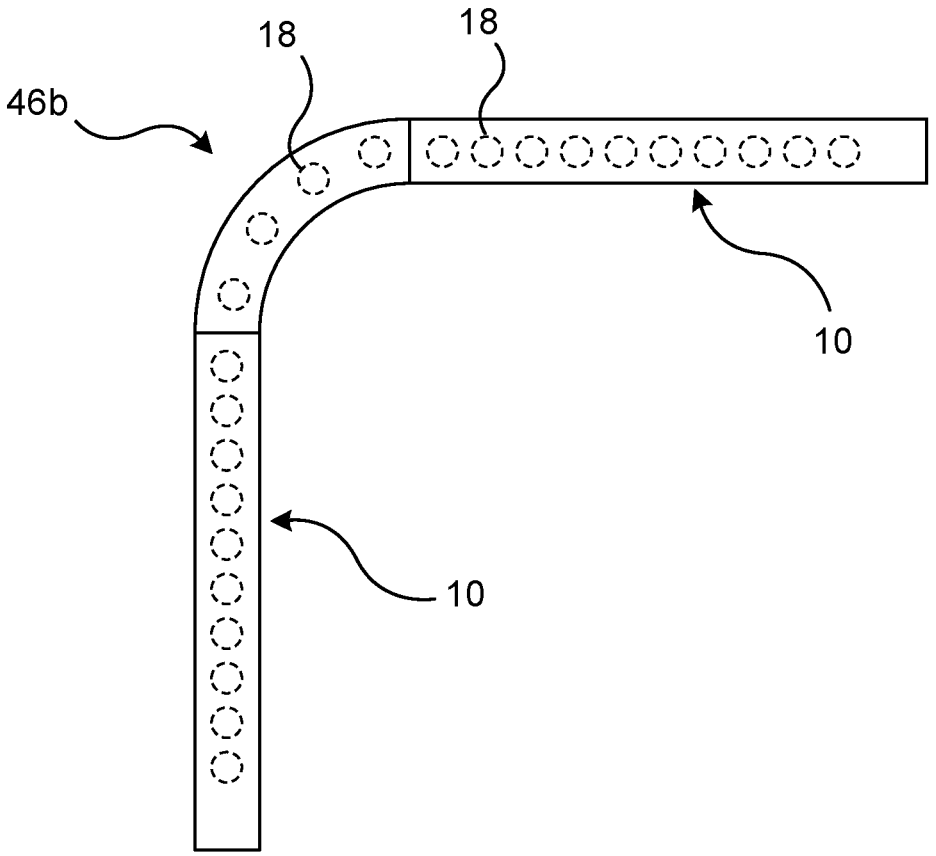
Figure 6C:
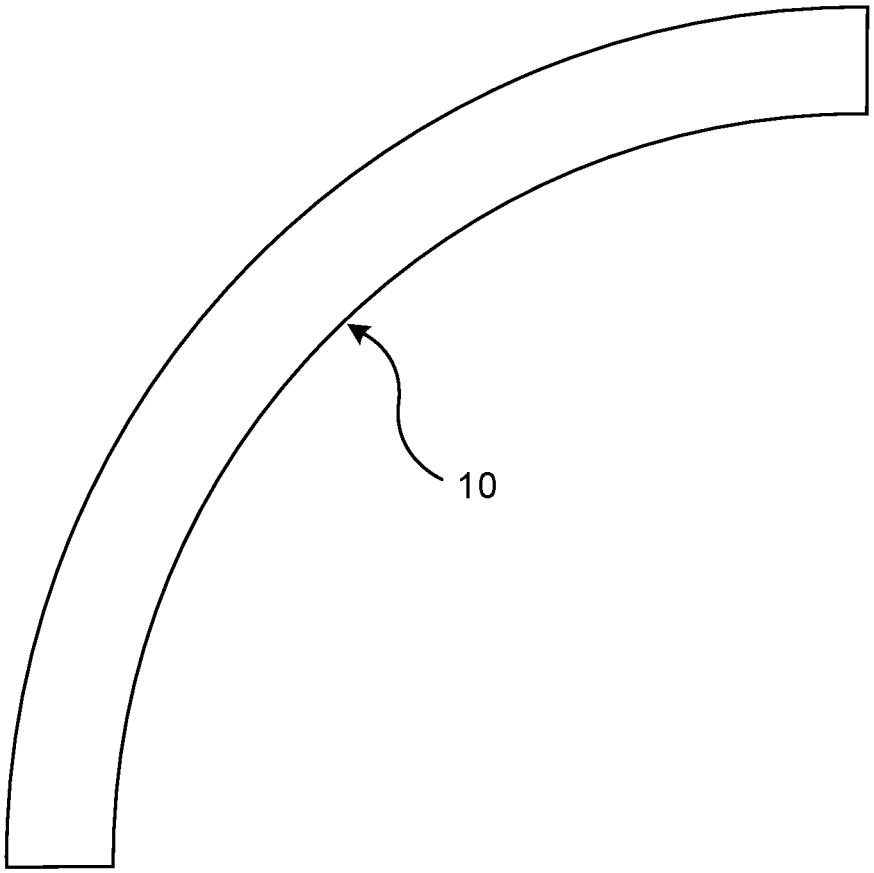
Figure 7:
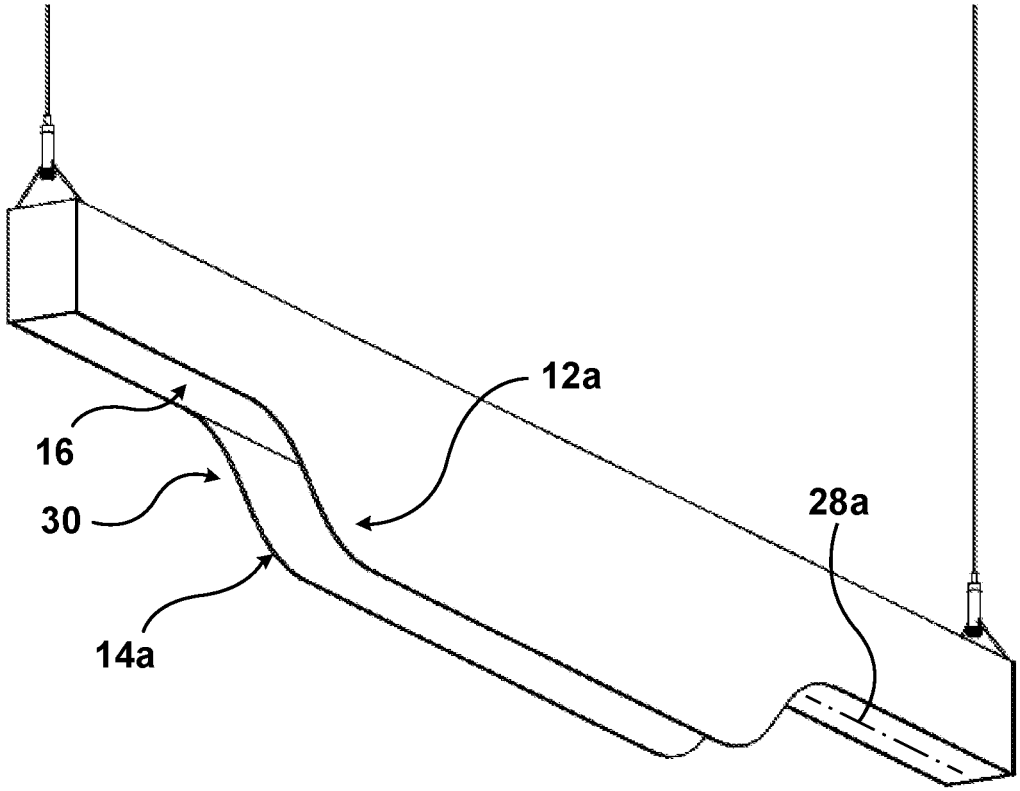
FIGS. 7 to 9 are perspective views of exemplary acoustic panels.
Figure 8:
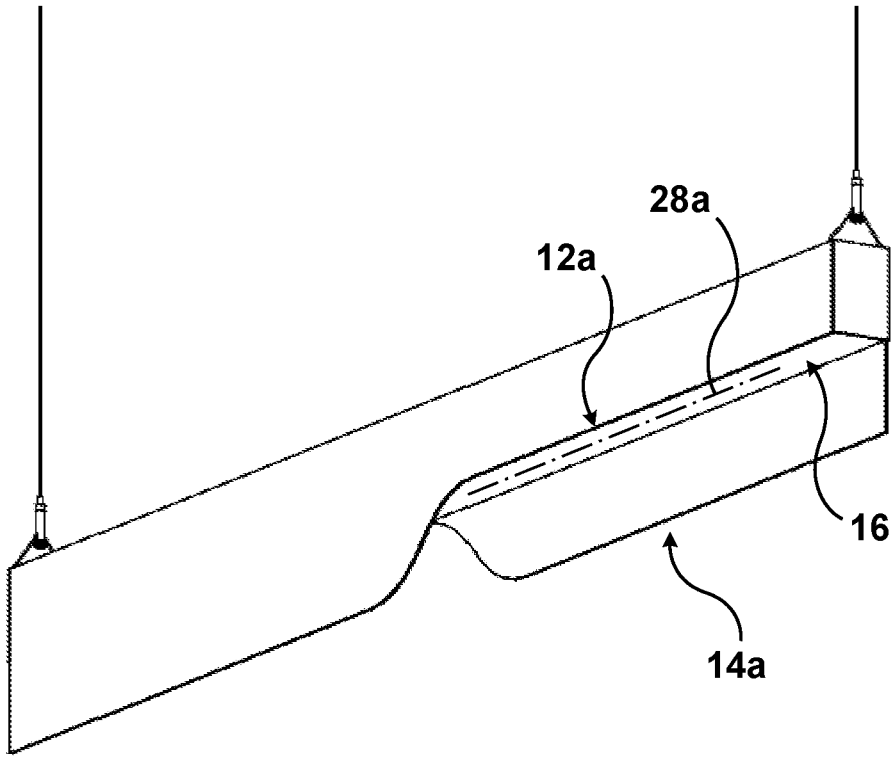
Figure 20:
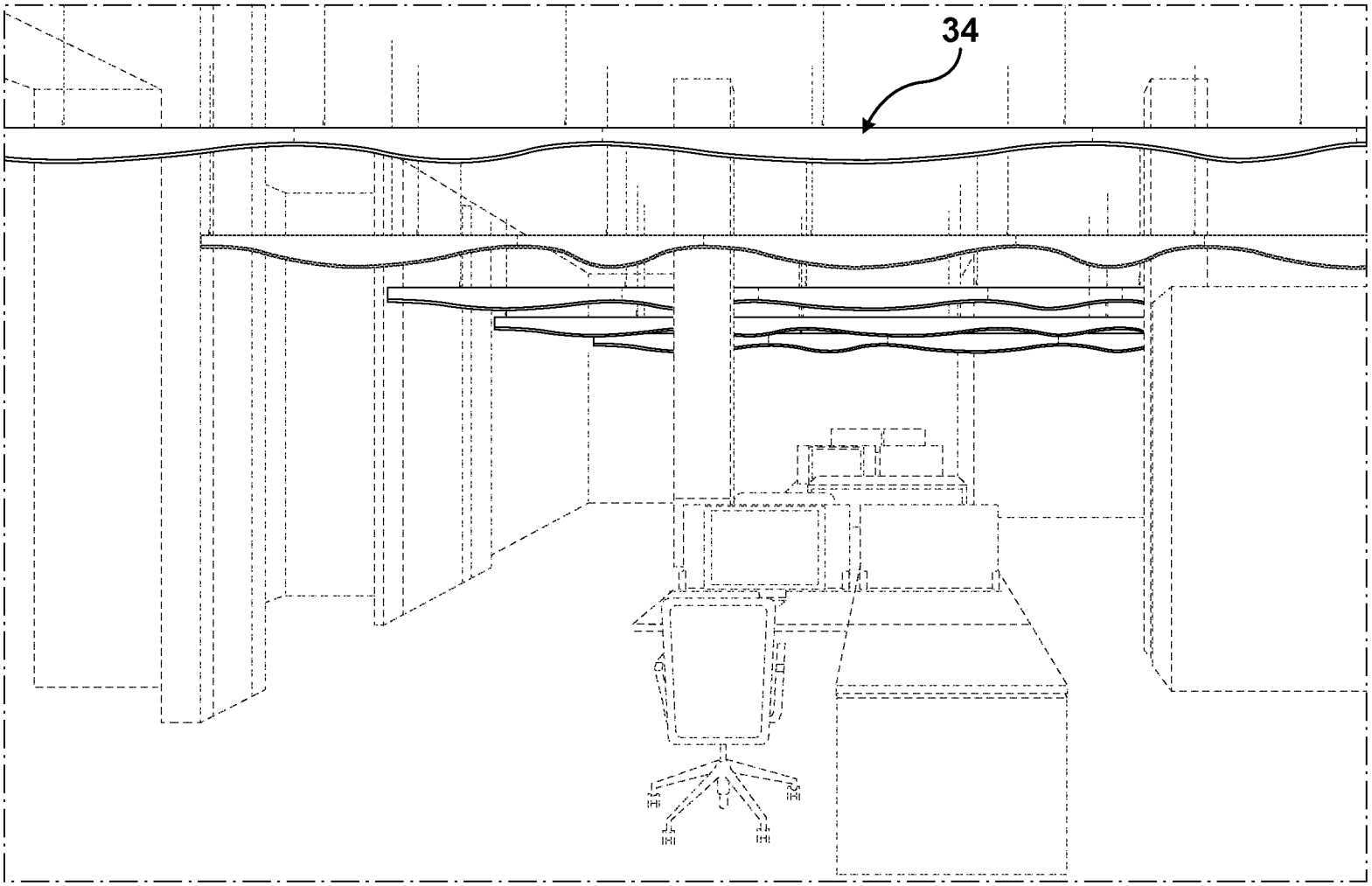

In some exemplary embodiments, one or both of the boundary regions 12*a*, 14*a* may be configured in a first mode in which the boundary regions 12*a*, 14*a* are aligned with the edge region 16, as shown in FIGS. 1 and 2. In this instance, the boundary regions 12*a*, 14*a* and edge regions 16 may follow one or more linear paths as shown at 28 which may be joined by transition regions 30. The transition regions may be smooth curved and thus present a sinusoidal-like profile, at least in part, as shown in FIG. 1. Alternatively, the transition regions may provide more linear profiles, as shown schematically by line 32 in FIG. 3. Alternatively, as shown in FIGS. 7 and 8, the path 28a may be planar along most or all of its length linear without a transition region (of the type shown at 30 and 32), or may for example have one or more such transition regions provided symmetrically or asymmetrically along its length. (FIG. 20, for example, illustrates a number of panel assemblies 34 which have varying dimensions, symmetries and the like.) The LED's 18 may then be located along the linear paths, the transition regions, or both, depending on a desired lighting effect. The shape and/or configuration of the edge region 16 may, in some exemplary embodiments, be patterned to provide, when installed, transition regions to direct lighting to designated regions of the inner space. In some exemplary embodiments, the paths may be linear in repeating or non-repeating sections, which may be joined by angled or curved sections 44*a*, 44*b* to form acoustic panels that can follow a corner or other transition in an interior space, such as shown in FIGS. 6*a* and 6*b*, Further, the panel itself may be curved along a radius as shown in FIG. 6*c*.

Figure 9:
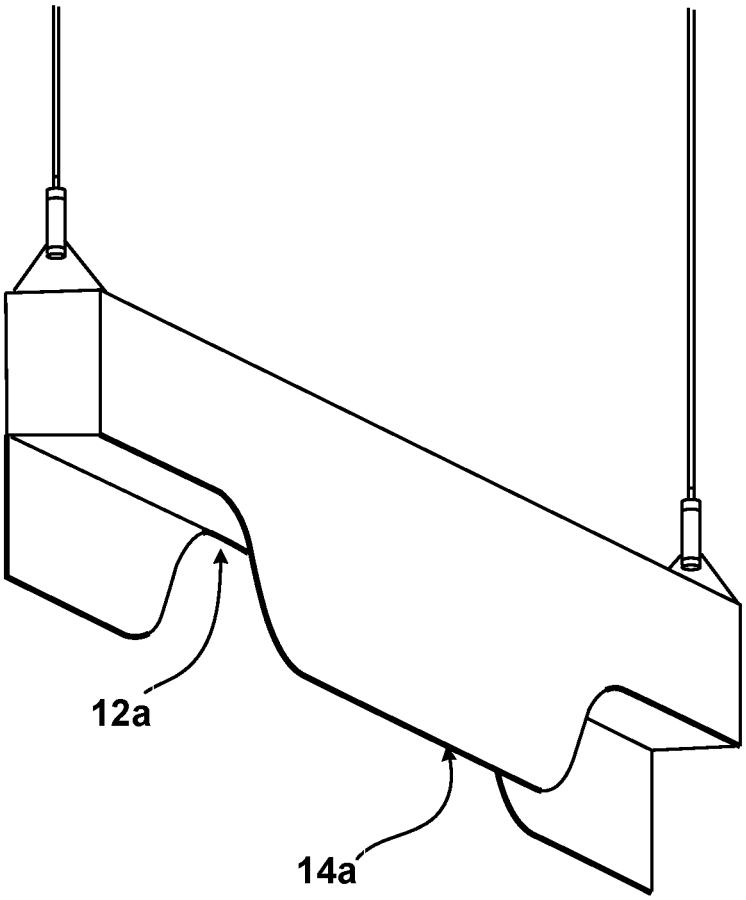

In some exemplary embodiments, such as shown in FIGS. 7 to 9, one or both of the boundary regions 12*a*, 14*a* may be configured in a second mode in which one or both of the boundary regions 12*a*, 14*a* extend beyond, so as to overlap or be offset relative to, the edge region 16. Thus, the one or more transition regions 30 may thus transition the boundary regions 12*a*, 14*a* between a zone corresponding to the first mode and a zone corresponding to the second mode. Further, in some exemplary embodiments, as shown in FIGS. 8 and 9, the first mode of one of the boundary regions, as shown for boundary region 12*a*, may align with the second mode of the opposed boundary region 14*a*.

Figure 10:
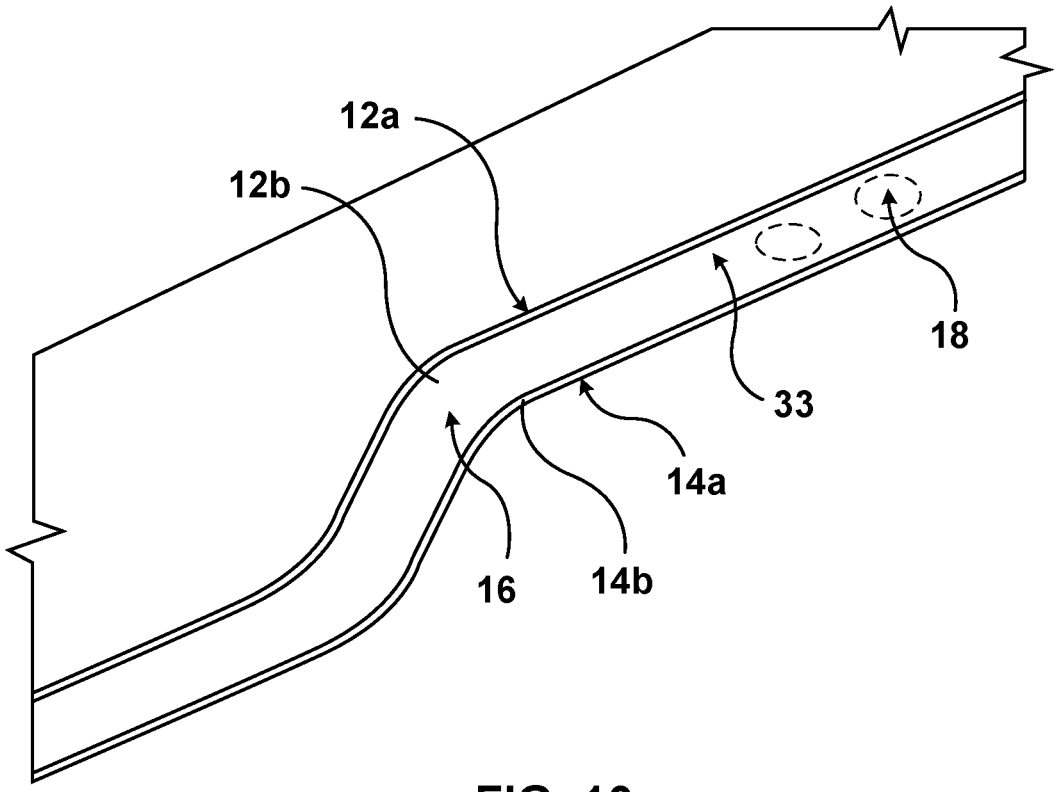
FIGS. 10 and 11 are fragmentary perspective views of exemplary acoustic panels.
Figure 11:
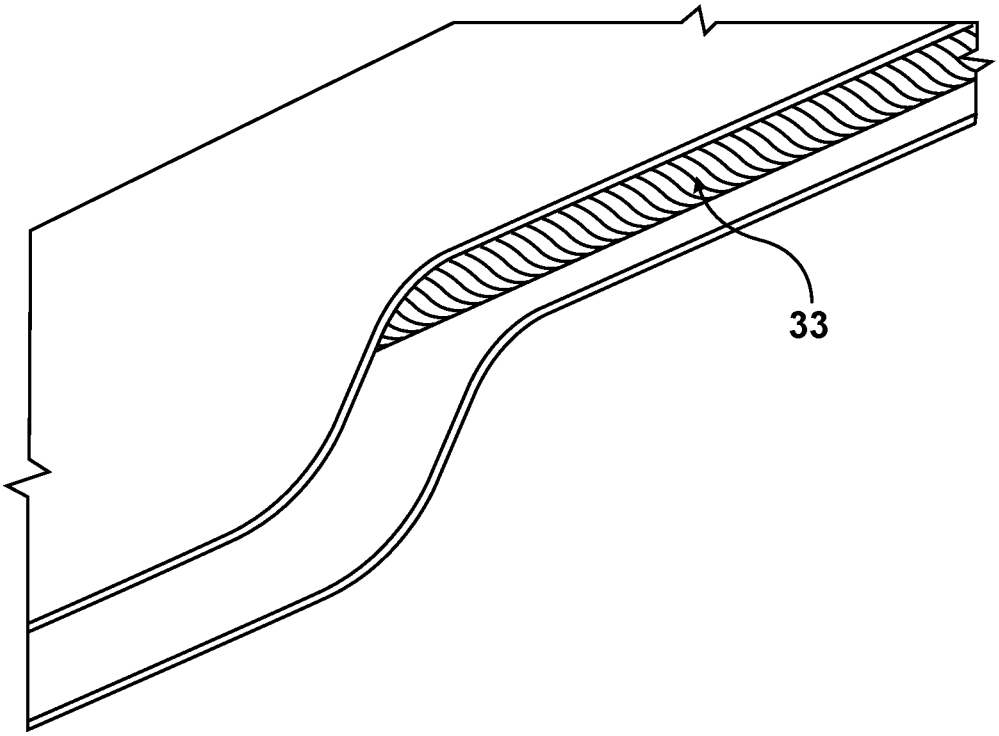

Referring to FIG. 10, each of the boundary regions 12*a*, 14*a* may be provided with peripheries 12*b*, 14*b* providing a border in the plane of the edge region 16. An optic lens 33 may be positioned between the peripheries 12*b*, 14*b* to cover the distribution of LED's 18, as shown, or the LEDs may alternatively be exposed in another configuration, either with no lens 33 or by a mesh or screen structure or the like, not shown. Thus, in the first mode for both the linear paths 28 and the transitions zones 30, the lens 33 may be flush with the peripheries 12*b*, 14*b*, while in the second mode, the lens 33 may be overlapped by the outer panels in a number of different configurations from a relatively shallow overlap, to a deep overlap as shown in FIG. 11. FIG. 11 further illustrates a variation for the optics of the lens 33. Other lens configurations may be deployed if desired. The overlap, shallow or deep therebetween, may be provided by just one of the outer panel portions, or by both opposed outer panel portions. In the latter instance, the overlap of the opposed outer panel portions may an aligned overlap as shown in FIG. 7 or an offset or misaligned overlap as shown in FIGS. 8 and 9. In the latter case, the offset overlap may be regular to form a repeating pattern of overlap or may be a random overlap.

Figure 17:
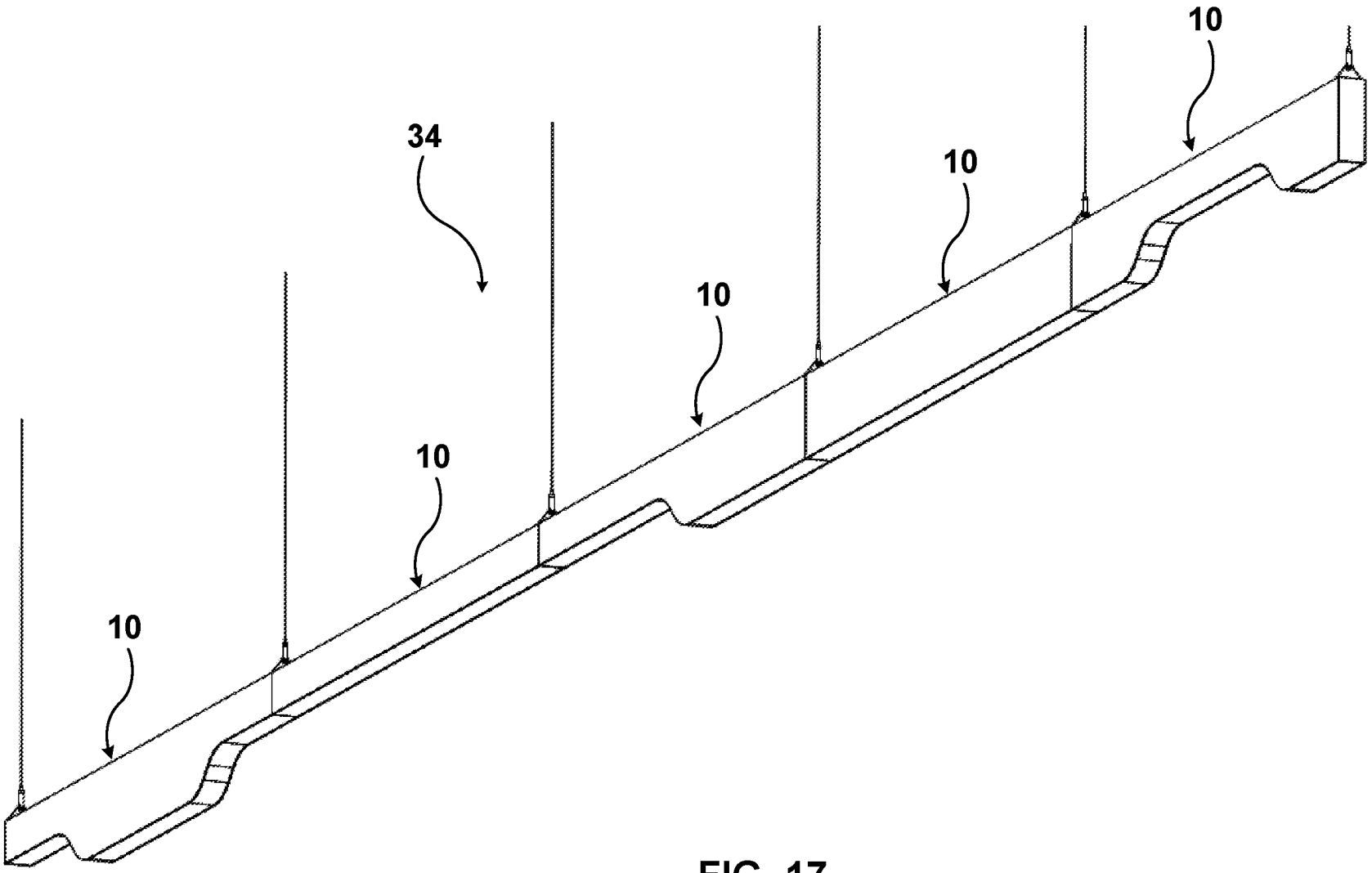
FIGS. 17 to 20 are views showing exemplary acoustic panel assemblies.
Figure 18:
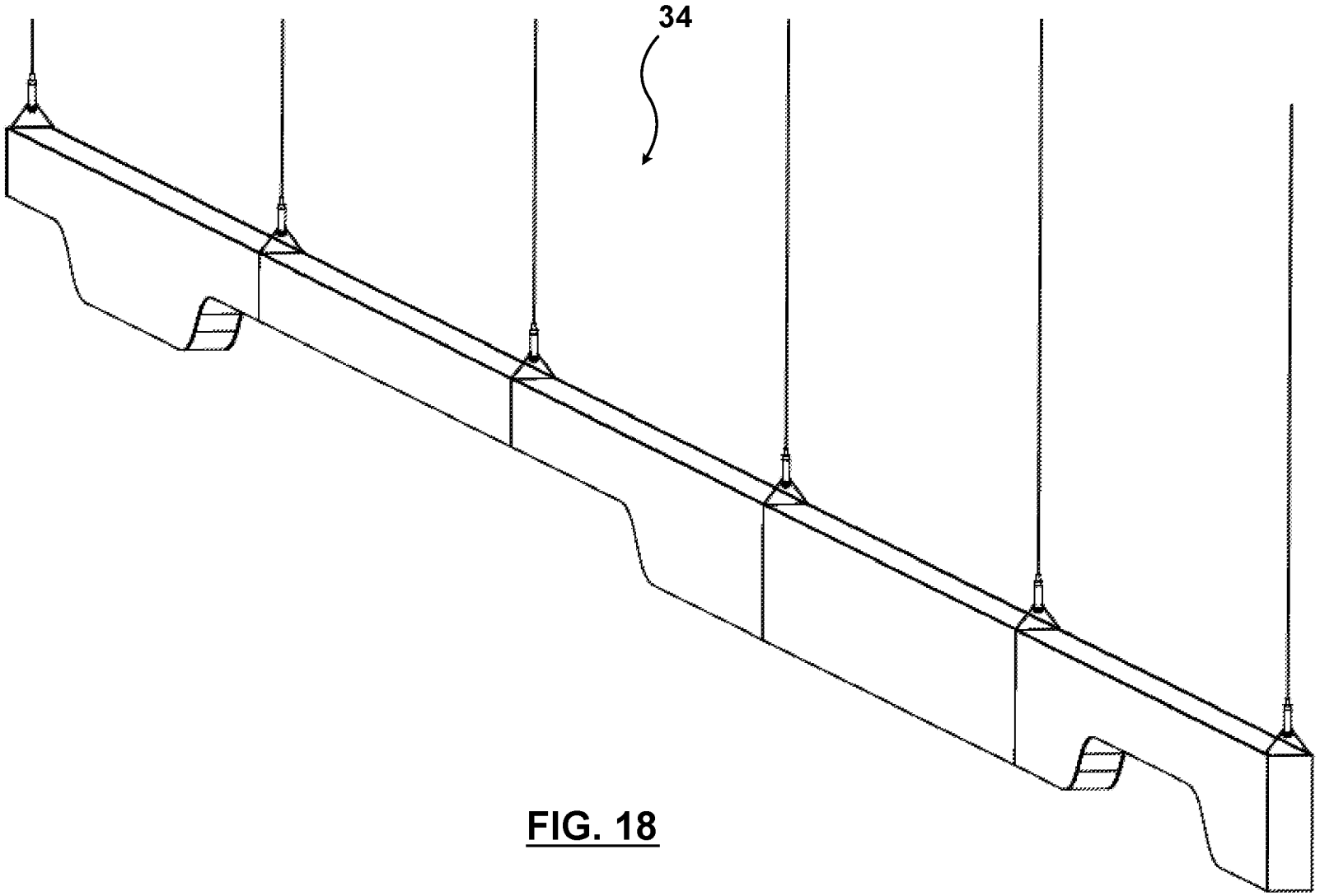
Figure 19:
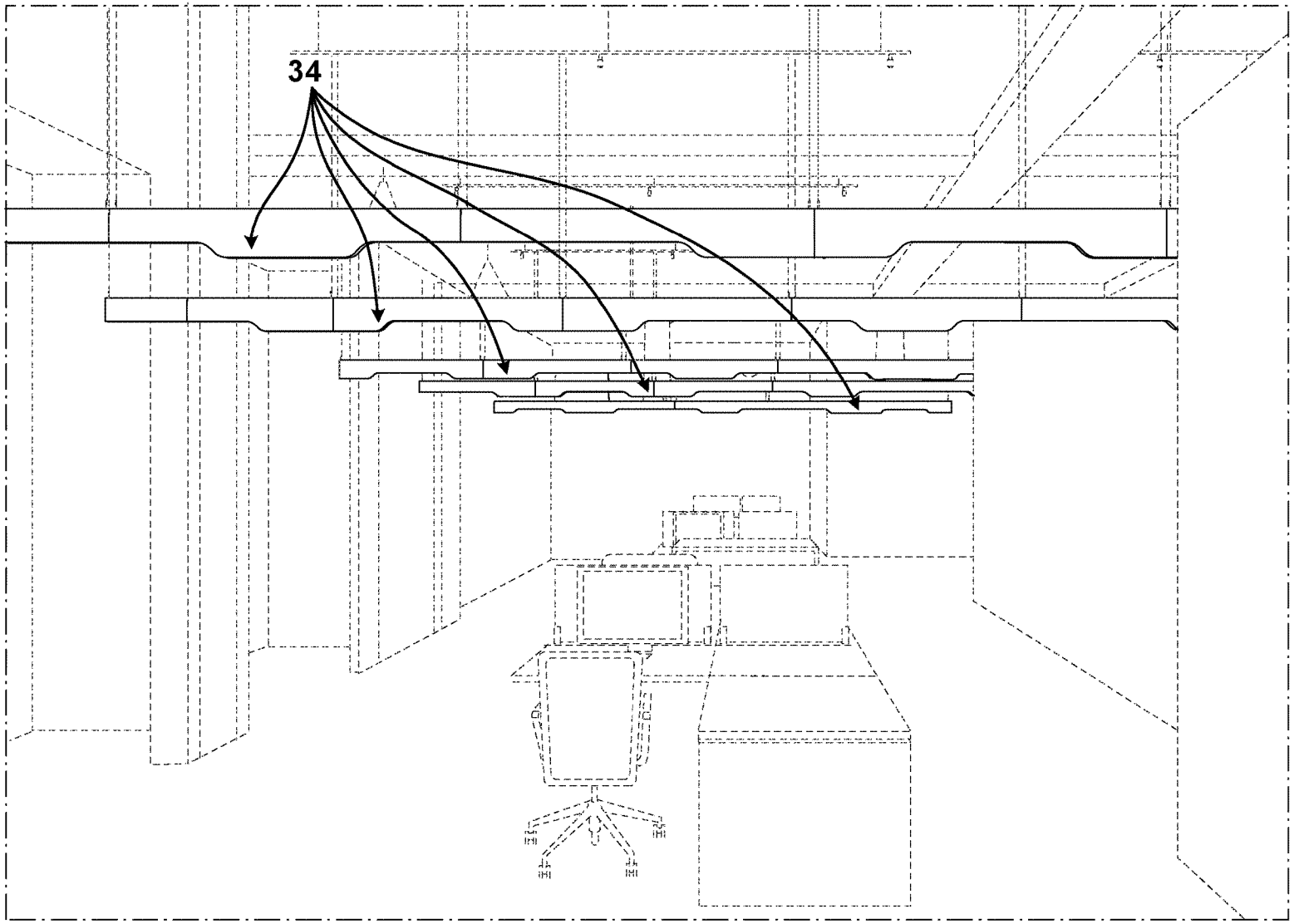

Thus, the configurations of the exemplary one or more acoustic panel outer surfaces 12, 14 and the edge region 16 provide a number of variables which may be combined to present a wide range of edge profiles of the acoustic panel 10 to present a variety of visual and/or acoustic effects in an interior space, for example when suspended or fastened to a ceiling structure, such as a T-bar ceiling structure, or another ceiling structure, as shown for example in FIG. 19, or a wall structure, and among other possible shapes and configurations. In this case, the acoustic panels may be assembled, end -to-end, to form an assembly 34, as shown in FIGS. 17 to 19 in one example, to provide an overall length corresponding to designated design parameters for the space.

Figure 5:
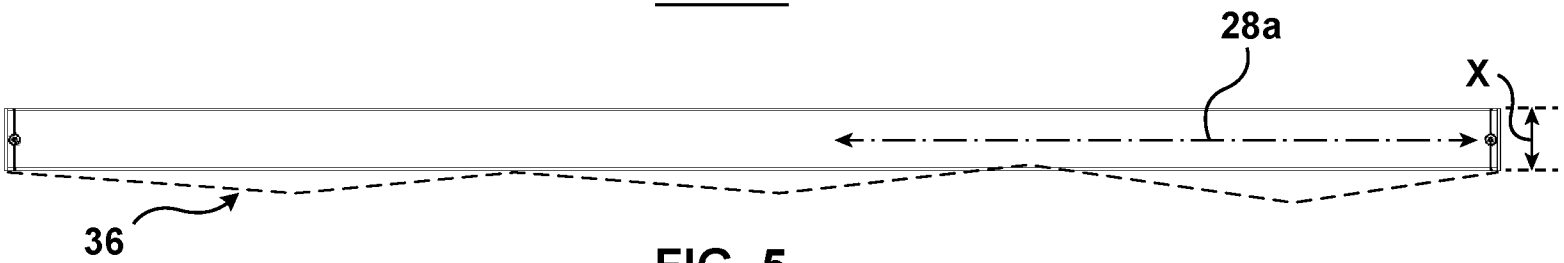
Figure 4:
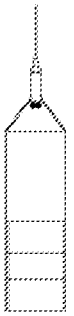
Figure 12:
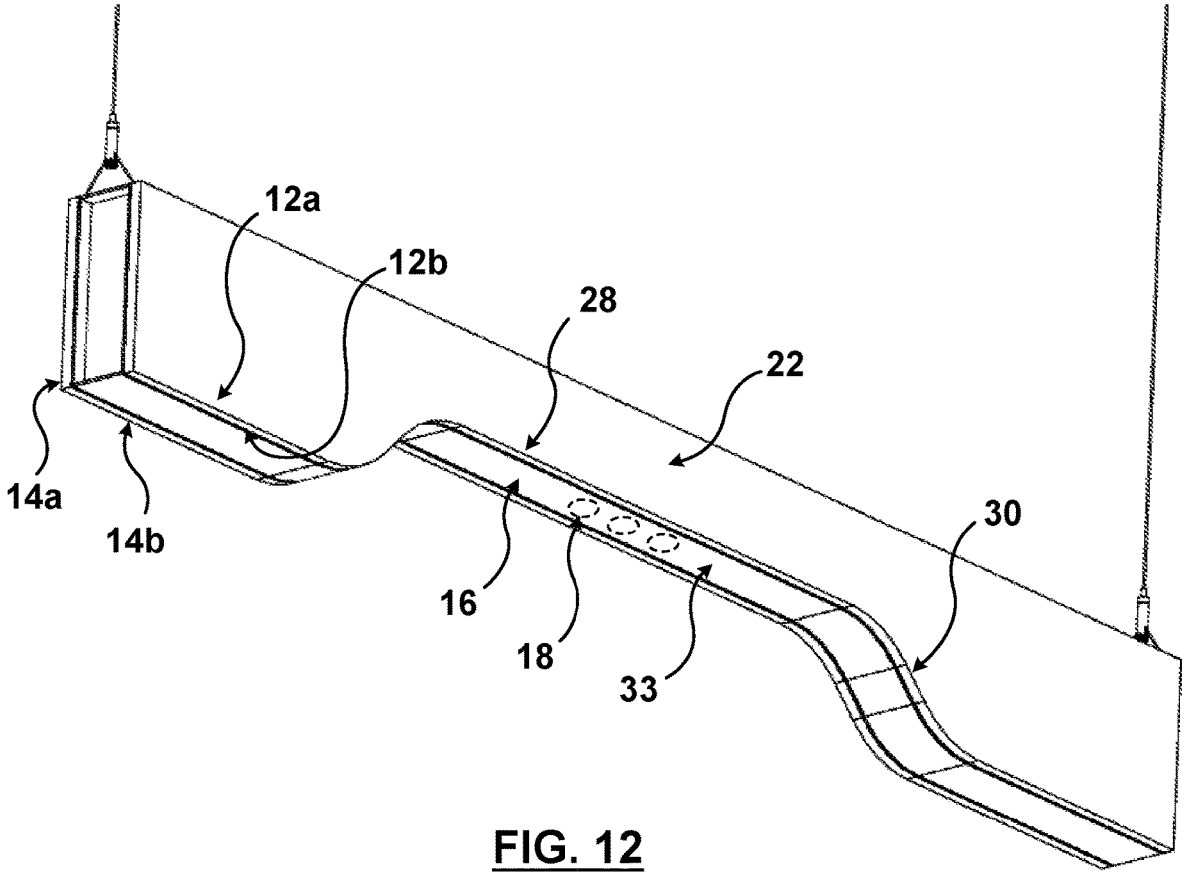
FIGS. 12 and 12*a* are a perspective view and a sectional view respectively of an exemplary acoustic panel.
Figure 12A:
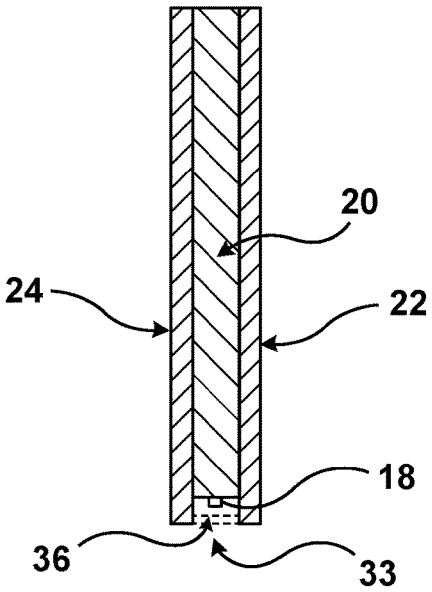
Figure 13:
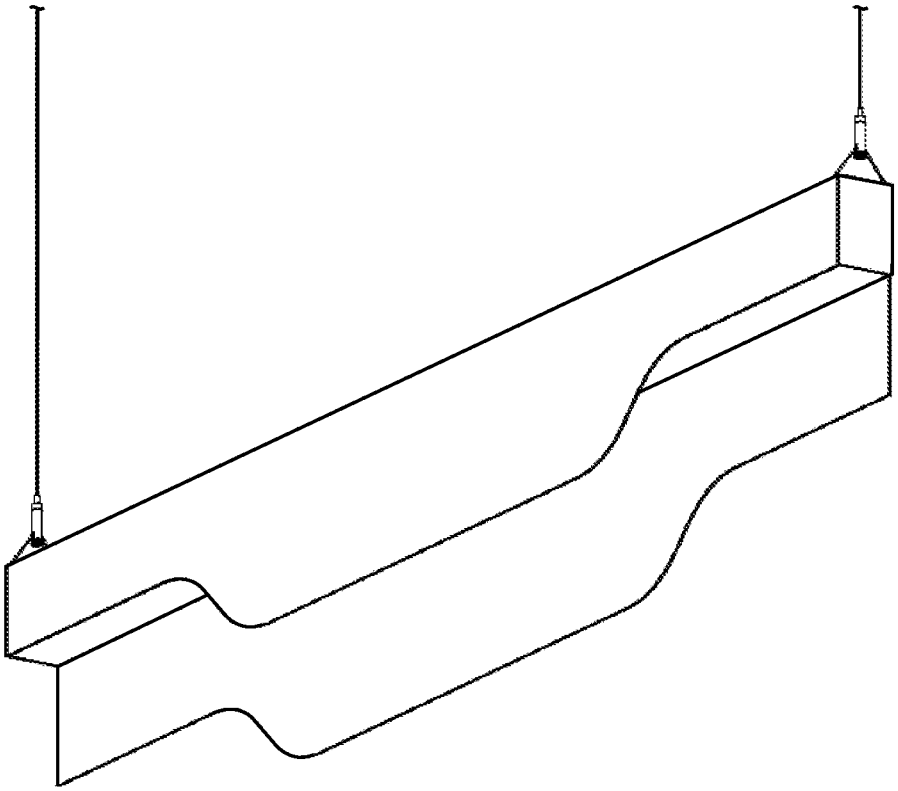
FIGS. 13 and 14 are fragmentary perspective views of exemplary acoustic panels.
Figure 14:
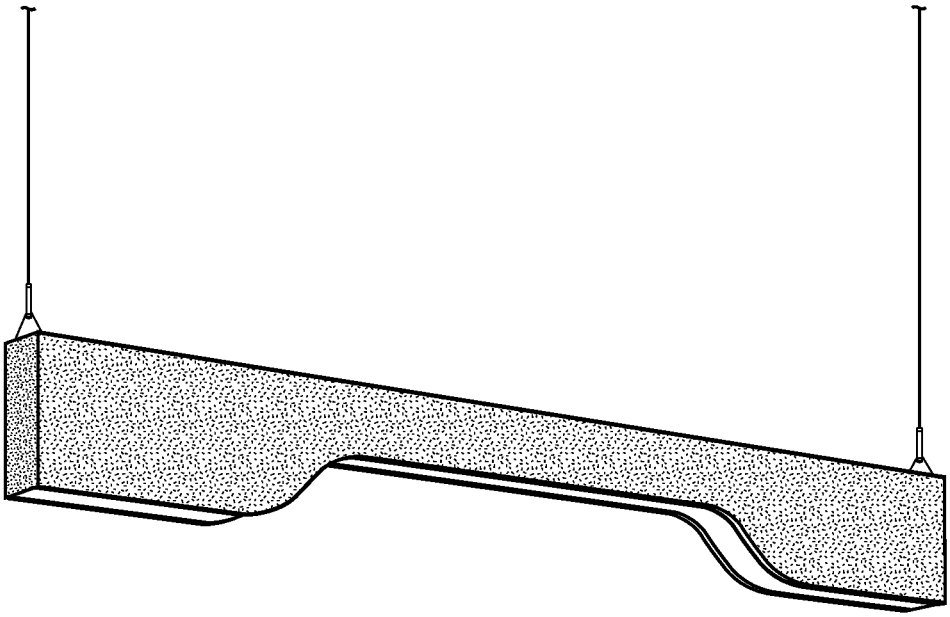

Referring to FIGS. 12 and 12*a*, in some exemplary embodiments, the outer panel portions 22, 24 may be provided on either side of at least one inner panel portion 20, and formed of sound absorbing material or of various combinations of sound absorbing materials presently known, or hereinafter discovered, which may include, by way of illustration but not limitation, porous natural or polymeric fibers, foams, particulate matrices and the like. Alternatively, the outer panel portions 22, 24 may be provided with an acoustic outer cover layer, once again by way of illustration but not limitation, such as felt or other fibrous or porous material. The outer panel portions 22, 24 may be planar as shown in FIGS. 12 and 12*a*, or be provided with other non-planar configurations as shown schematically by line 36 in FIG. 5, in conjunction with other panels as may be placed in an acoustic configuration in the ceiling structure. Still further, the inner and outer panel portions may bonded together to form a composite panel, or be portions of a unitary structure formed from a single blank of acoustic material, or a blank of material wrapped in an acoustic material, or the like. The LED's 18 may be located in a recess, as shown at 36, or instead located along the edge region 16 with or without a lens 33.

Figure 15:
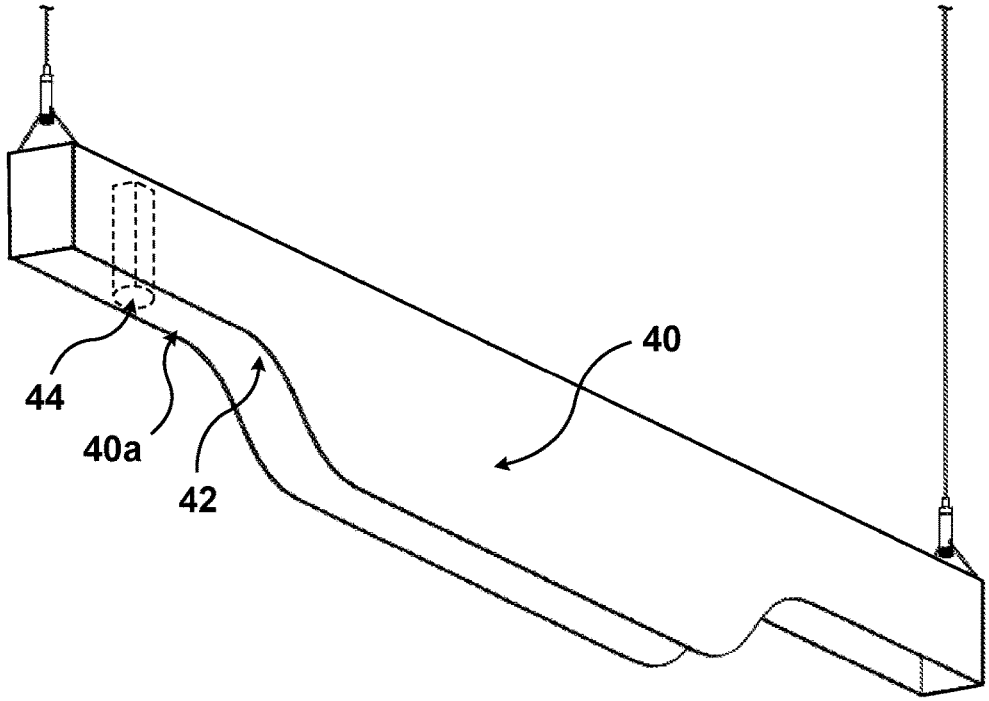
FIGS. 15 and 16 are fragmentary perspective views of an exemplary acoustic panel.
Figure 16:
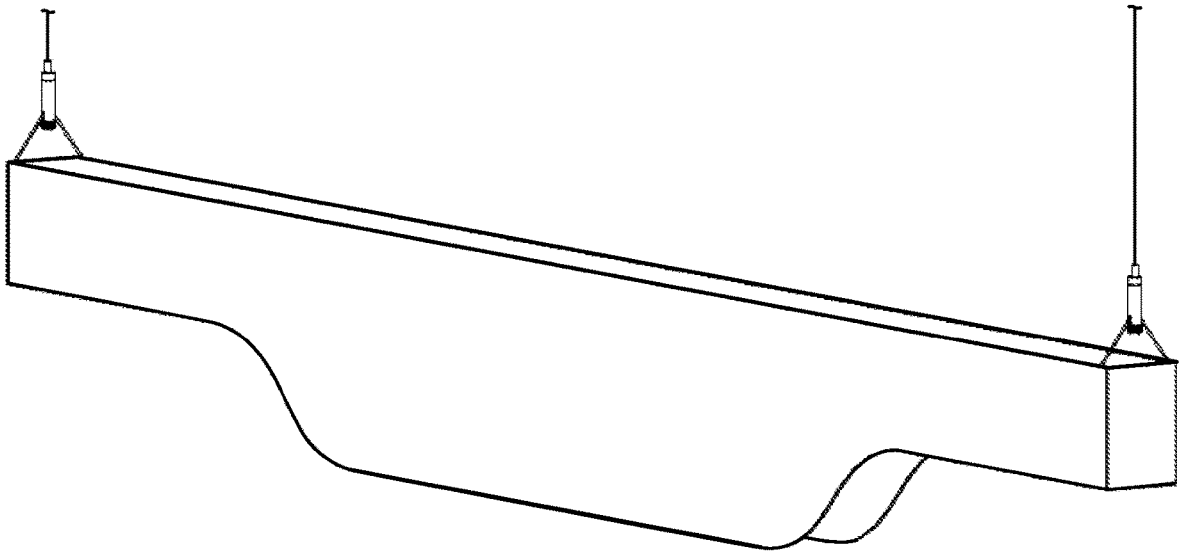

In some exemplary embodiments as shown in FIGS. 7 to 9, 11, 13, 15 and 16, the panel 10 may be formed as a box-like, at least partially hollow (such as shown in FIG. 15), or extending wall baffling enclosure 40, with an opening 40a to an interior space 42 in which one or more lighting elements may be located, either as the distribution of LED's 18 as above described, or as one or more discrete light emitting units as shown schematically at 44. In some exemplary embodiments, hollow structure, or extending walls may provide further disruption of sound wave propagation, which may occur as a result of interfering with the propagation of the sound waves that encounter the irregular structures which also prevent, scatter, or at least reduce sound wave reflection.

Thus, in some exemplary embodiments, acoustic panels may provide for improved acoustic effect in an interior space while also providing improved lighting by way of LED's 18, when suspended either alone or in end-to-end assemblies 34, in one or more designated repeating curved, rectangular, linear, circular or other patterns, at least in part as shown, in the interior space, so that the upright acoustic surfaces 12, 14 may be operable for a desired acoustic effect, while the distribution of LED's 18, or light emitting units 44, along respective longitudinal edge regions may provide effective interior lighting. In the exemplary embodiments of FIGS. 6*a* and 6*b*, an acoustic panel assembly 34 has a pair of acoustic panels 10 jointed by a joining sections 46*a*, 46*b* which may be angular, as shown in FIG. 6*a*, curved as shown in FIG. 6*b*, or another configuration and which may or may include not one or more acoustic features and LEE's 18 of the acoustic panels 10, as shown in FIG. 6*b*. In this case, the LED's or light emitting units may be provided either on a lower longitudinal edge region to provide direct lighting, an upper longitudinal edge region to provide indirect lighting, or both. FIG. 6*c* shows a panel 10 which is curved about a radius.

The acoustic panels may be mounted in a pendant fashion, as shown in FIG. 19, or in a non-pendant fashion, either on the ceiling, or a wall surface. The acoustic panels as shown herein may also be used in an inverted configuration so that the boundary regions 12*a*, 14*a* and the edge region 16 face upward toward the ceiling structure or wall structure, as the case may be.

In some exemplary embodiments, the panel may be prepared to perform as a baffle, with outer acoustic outer panel portions which may incorporate soundproofing materials to diffuse standing waves and reflections, such as open cell foams, fiberglass, porous or diffuse materials, among other possible materials, with different surface shapes and configurations to provide variations in absorption ratings for a particular interior space. For example such panels may have a thickness and density suitable for a designated Noise Reduction Coefficient ("NRC"). For instance, an acoustic product with a 0.95 NRC rating means that 95% of sound in the space is absorbed, while the other 5% is reflected. Thus, some exemplary embodiments may provide at least one sound absorbing surface with an NRC rating ranging from about 0.50 to about 0.99, or more particularly from about 0.75 to about 0.95.

In some exemplary embodiments, the acoustic panels may have one or more cross sectional widths X ranging from about 1.5 inches to about 6 inches, in some cases from about 2.5 inches to about 4.5 inches, while other dimensions may also be applicable in some cases.

In some exemplary embodiments, the acoustic panels may have one or more cross sectional depths Y1, Y2 ranging from about 2.5 inches to about 15 inches, in some cases from about 4 inches to about 10 inches, in some cases, in some cases from about x inches to x inches.

While the present disclosure describes various exemplary embodiments, the disclosure is not so limited. To the contrary, the disclosure is intended to cover various modifications and equivalent arrangements, as will be readily appreciated by the person of ordinary skill in the art.

The invention claimed is:

1. An elongate acoustic panel for installation in an interior space comprising at least one acoustic surface, an edge region adjacent to the at least one acoustic surface, and a distribution of one or more light emitting elements (LEE's) along the edge region, wherein the at least one acoustic surface includes a boundary region, the edge region being positioned adjacent the boundary region, and wherein the boundary region has a periphery which transitions between a first mode in which the boundary region is aligned with the edge region and a second mode in which the periphery extends beyond the edge region.

2. The panel of claim 1, wherein the at least one acoustic surface includes a pair of opposed outer acoustic surfaces, with the edge region therebetween.

3. The panel of claim 2, further comprising an inner panel portion having a periphery, wherein the edge region is defined on the periphery.

4. The panel of claim 3, further comprising a pair of outer acoustic panel portions on opposite sides of the inner panel portion.

5. The panel of claim 2, wherein the boundary region has a periphery which transitions between a first mode in which the boundary region is aligned with the edge region and a second mode in which the periphery extends beyond the edge region.

6. The panel of claim 5, wherein the periphery includes at least one transition between at least one first mode and at least one second mode.

7. The panel of claim 6, wherein the opposed surfaces have respective peripheries which transition between the first mode and the second mode.

8. The panel of claim 7, wherein the first mode of one of the peripheries aligns with the second mode of an opposed periphery.

9. The panel of claim 1, wherein the at least one acoustic surface provides an NRC rating ranging from about .50 to about .99.

10. The panel of claim 1, wherein the at least one acoustic surface provides an NRC rating ranges from about .75 to about .95.

11. The panel of claim 1, further comprising an enclosure in communication with the edge region to receive the LEE'S therein.

12. A panel assembly comprising a plurality of panels as defined in claim 1.

13. An assembly as defined in claim 12, wherein the plurality of panels includes at least one pair of panels with a joining section therebetween.

14. An assembly as defined in claim 13 wherein the joining section comprises one or more surfaces and/or edge regions which are substantially aligned, oriented, parallel or offset relative to at least one corresponding surface and/or corresponding edge region on one or more neighboring surfaces on one or more of the panels.

15. An acoustic panel comprising a pair of outer acoustic panel portions forming one or more boundary regions, and a light emitting element (LEE) fixture structure therebetween, the LEE fixture structure configured to deliver light to the boundary regions, at least in part, wherein the one or more boundary regions have a periphery which transitions between a first mode in which the one or more boundary regions are aligned with the LEE fixture structure and a second mode in which the periphery extends beyond the LEE fixture structure.

16. A panel as defined in claim 15, wherein the LEE fixture structure includes an edge region and an array of one or more LEE' s distributed therealong.

17. A panel as defined in claim 16, wherein the LEE fixture structure is centrally located in the panel.

* * * * *